US005893457A

United States Patent [19]

Wei

[11] Patent Number: 5,893,457

[45] Date of Patent: Apr. 13, 1999

[54] TOOL BOX

[76] Inventor: Yong Lung Wei, 6F-6, 186, Section 1, Wen Hsin Rd., Taichung, Taiwan

[21] Appl. No.: 09/058,454

[22] Filed: Apr. 10, 1998

[51] Int. Cl.[6] ..... B65D 85/00

[52] U.S. Cl. ..... 206/373; 206/377; 206/378; 312/902

[58] Field of Search ..... 206/372–379; 312/304, 902

[56] References Cited

U.S. PATENT DOCUMENTS

| | | | |
|---|---|---|---|
| 1,882,756 | 10/1932 | Boynton | 312/902 |
| 2,401,667 | 6/1946 | Segur | 312/902 |
| 2,775,342 | 12/1956 | Smith | 206/379 |
| 3,074,539 | 1/1963 | Rogovin | 206/379 |
| 4,768,652 | 9/1988 | Fallon | 206/379 |
| 5,746,316 | 5/1998 | La Barre | 206/379 |

*Primary Examiner*—Jim Foster

[57] ABSTRACT

A tool box includes a base portion with two side walls, two sliding plates slidably disposed to the two side walls and a plurality of receiving members pivotally connected between the two side walls at two ends of a front side thereof. The receiving members further are pivotally connected to the two sliding plates at the two ends of a rear side thereof. An actuating member is pivotally connected between the two side walls at two ends of a front side thereof, and between the two sliding plates at the two ends of a rear side thereof so that when pivoting the actuating member about the two ends of the front side thereof, the two sliding plates and the rear side of each the receiving members are moved upwardly.

8 Claims, 4 Drawing Sheets

TOOL BOX

BACKGROUND OF THE INVENTION

1. Field of the Invention

The present invention relates to a tool box comprising a plurality of receiving members pivotally connected between two sliding plates which are actuated by an actuating member so that when operating the actuating member, the receiving members are pivoted an angle corresponding to a horizontal plane.

2. Brief Description of the Prior Art

Conventional tool boxes generally includes a base portion and a cover which is pivotally connected to the base portion in which a plurality of recesses are defined so as to receive tools therein. Those recesses are integrally defined in the base portion so that there are limitations of types and/or shapes of tools to be received. Furthermore, the base portion is designed to put on a horizontal surface so that a user has to search the tools received in the recesses because some tools disposed in a faraway side of the base portion could be hidden, and the tools have to be picked vertically from the recesses and this action is not convenient for the user, a preferred direction of picking the tools is about 45 degrees corresponding to the horizontal plane. These shortcomings can be seen in most of the tool boxes presented in the market.

The present invention provides an improved tool box including a base portion and a cover wherein a plurality of receiving members are pivotally connected between two sliding plates which are actuated by an actuating member so as to slide the sliding plates to let all the receiving members be pivoted inclinedly. Therefore the above mentioned shortcomings may be mitigated.

SUMMARY OF THE INVENTION

In one aspect of the present invention, there is provided a tool box comprising a base portion having two side walls between which a bottom and a top are respectively transversely connected, and a back wall connected between two rear sides of the two side walls. Two sliding plates are respectively and slidably disposed to the side walls corresponding thereto. At least one receiving member is pivotally connected between the two side walls at two ends of a front side thereof and pivotally connected between the sliding plates at the two ends of a rear side thereof.

It is an object of the present invention to provide a tool box having a plurality of receiving members which are operated to be inclined corresponding to a horizontal plane.

It is another object of the present invention to provide a tool box which has two sliding plates between which the receiving members are pivotally connected.

How these and other objects are accomplished will become apparent from the following descriptions and from the drawings.

DETAILED DESCRIPTION OF THE PREFERRED EMBODIMENT

Figure 1:
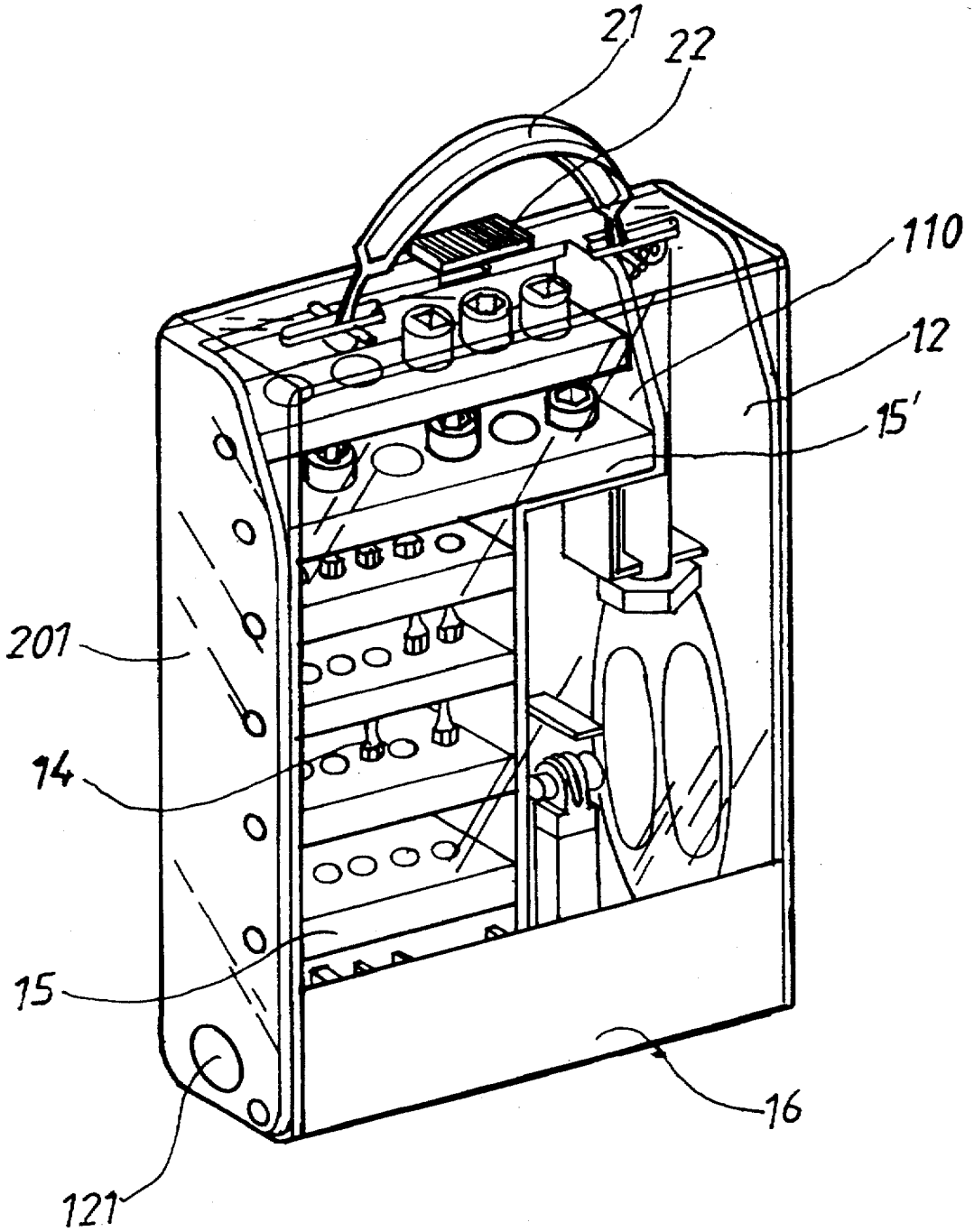
FIG. 1 is a perspective view of a tool box in accordance with the present invention.
Figure 2:
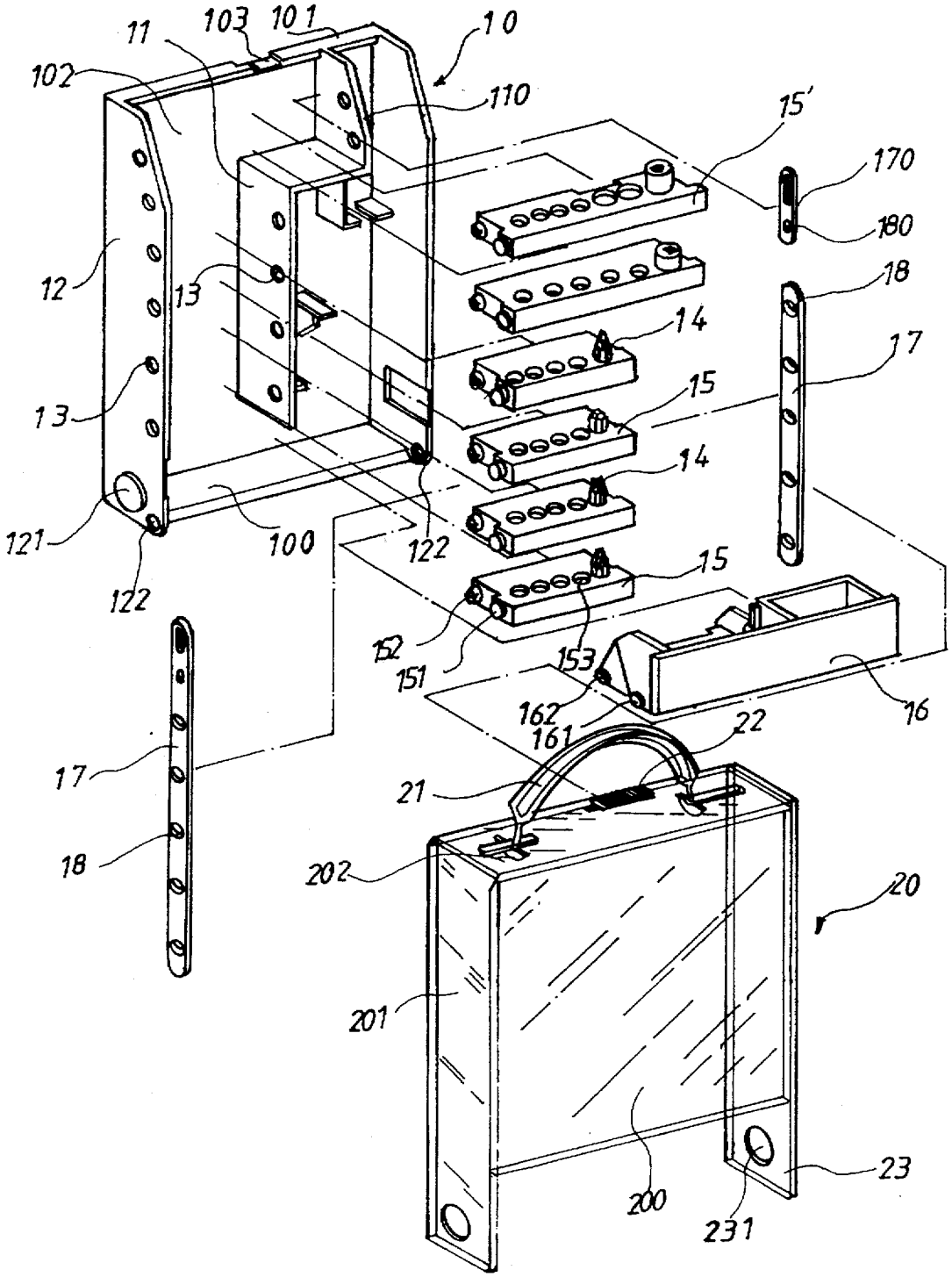
FIG. 2 is an exploded view of the tool box in accordance with the present invention.

Referring to the drawings and initially to FIGS. 1 and 2, a tool box in accordance with the present invention generally includes a base portion 10 in which a plurality of receiving members 15 and an actuating member 16 are respectively received and a cover 20 mounted to the base portion 10. The base portion 10 has two side walls 12 between which a bottom 13 and a top 101 are respectively transversely connected, a back wall 102 connected between two rear sides of the two side walls 12. A separating board 11 is disposed to the back wall 102 and one of the side walls 12 and the separating board 11 has a plurality of first apertures 13 defined therethrough. The two side walls 12 of the base portion 10 each have a boss 121 extending from an outer surface thereof.

Two sliding plates 17 are respectively and slidably disposed to the side wall 12 having the first apertures 13 and the separating board 11, and each the sliding plate 17 has a plurality of second apertures 18 defined therethrough. An auxiliary plate 170 having two apertures 180 defined therethrough is disposed to an extending portion 110 of the separating board 11, wherein a distance between the auxiliary plate 170 to the side wall 12 having the first apertures 13 is larger than a distance between the side wall 12 having the first apertures 13 to the separating board 11 so as to accommodate the two receiving members 15' which is longer then the others.

The receiving members 15 each are pivotally connected between the side wall 12 having the first apertures 13 and the separating board 11 at two ends of a front side thereof and pivotally connected between the sliding plates 17 at the two ends of a rear side thereof. In other words, the two ends of the front side of each the receiving member 15 each have a first stub 151 extending therefrom so as to be received in the first apertures 13 of the side wall 12 and the separating board 11. The two ends of the rear side of each the receiving member 15 each have a second stub 152 extending therefrom so as to be received in the second apertures 18 of the two sliding plates 17.

The actuating member 16 is pivotally connected between the two side walls 12 at two ends of a front side thereof and pivotally connected between the sliding plates 17 at the two ends of a rear side thereof. In other words, the two ends of the front side of the actuating member 16 each have a first shaft 161 extending therefrom so as to be received in lower holes 122 respectively defined through the two side walls 12. The two ends of the rear side of the actuating member 15 each have a second shaft 162 extending therefrom so as to be received in the second apertures 18 of the two sliding plates 17. The receiving member 15 has a plurality of receiving recesses 153 defined therein so as to receive a tool such as a bit 14 therein and the actuating member 16 has a plurality of receiving portions defined therein so as to receive tools therein.

The cover 20 includes a front plate 200 with two side plates 201 extending from two opposite sides thereof, a top plate 202 connected between the two side plates 201 and two legs 23 extending from each of the two side plates 201. Each of the legs 23 of the cover 20 has a hole 231 defined therethrough so as to receive the boss 121 corresponding thereto. A handle 21 is disposed to the top plate 202 which further has a lock member 22 disposed thereto so as to be engaged with an engaging portion 103 disposed on the top 101 of the base portion 10.

Figure 3:
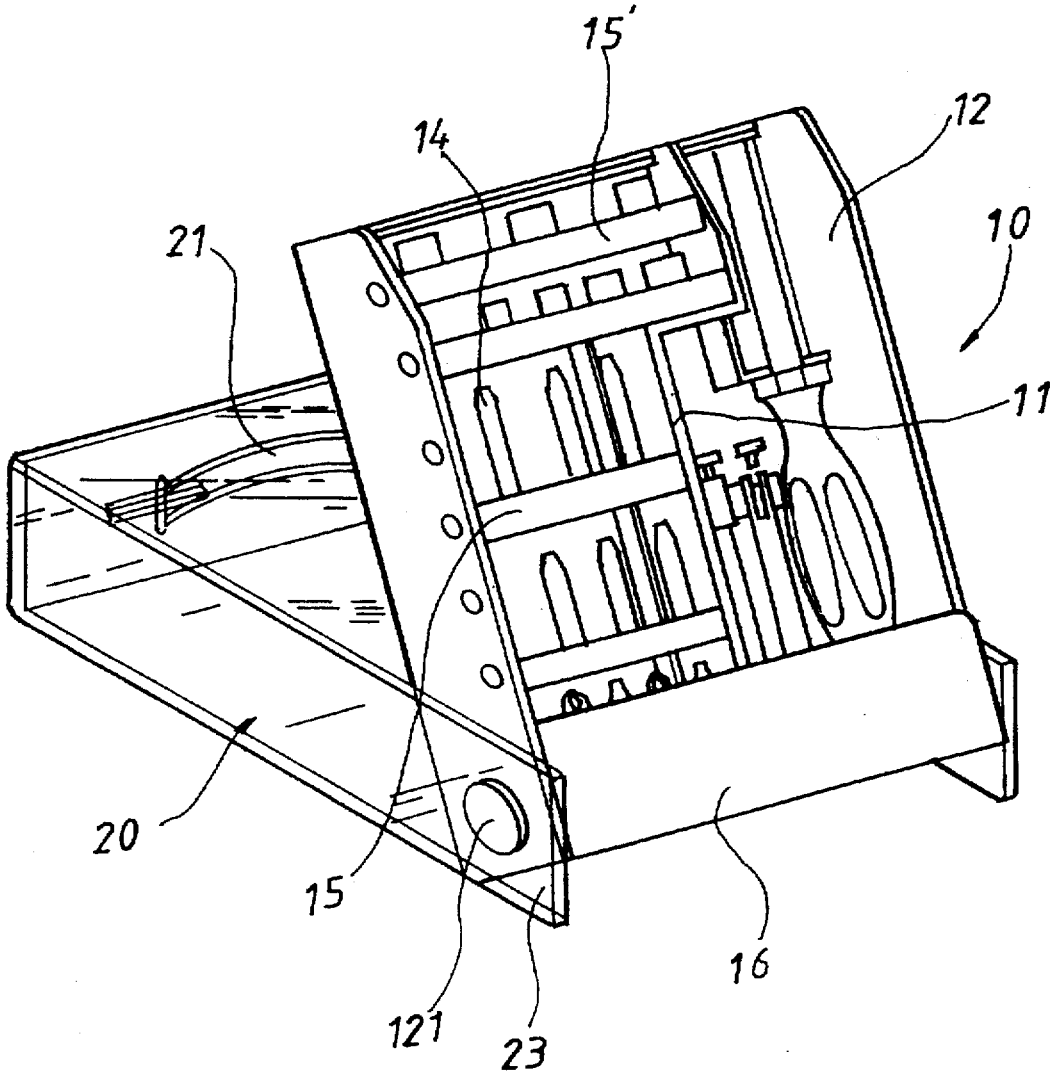
FIG. 3 is a perspective view of the tool box when a cover is pivoted corresponding to a base portion thereof.
Figure 4:
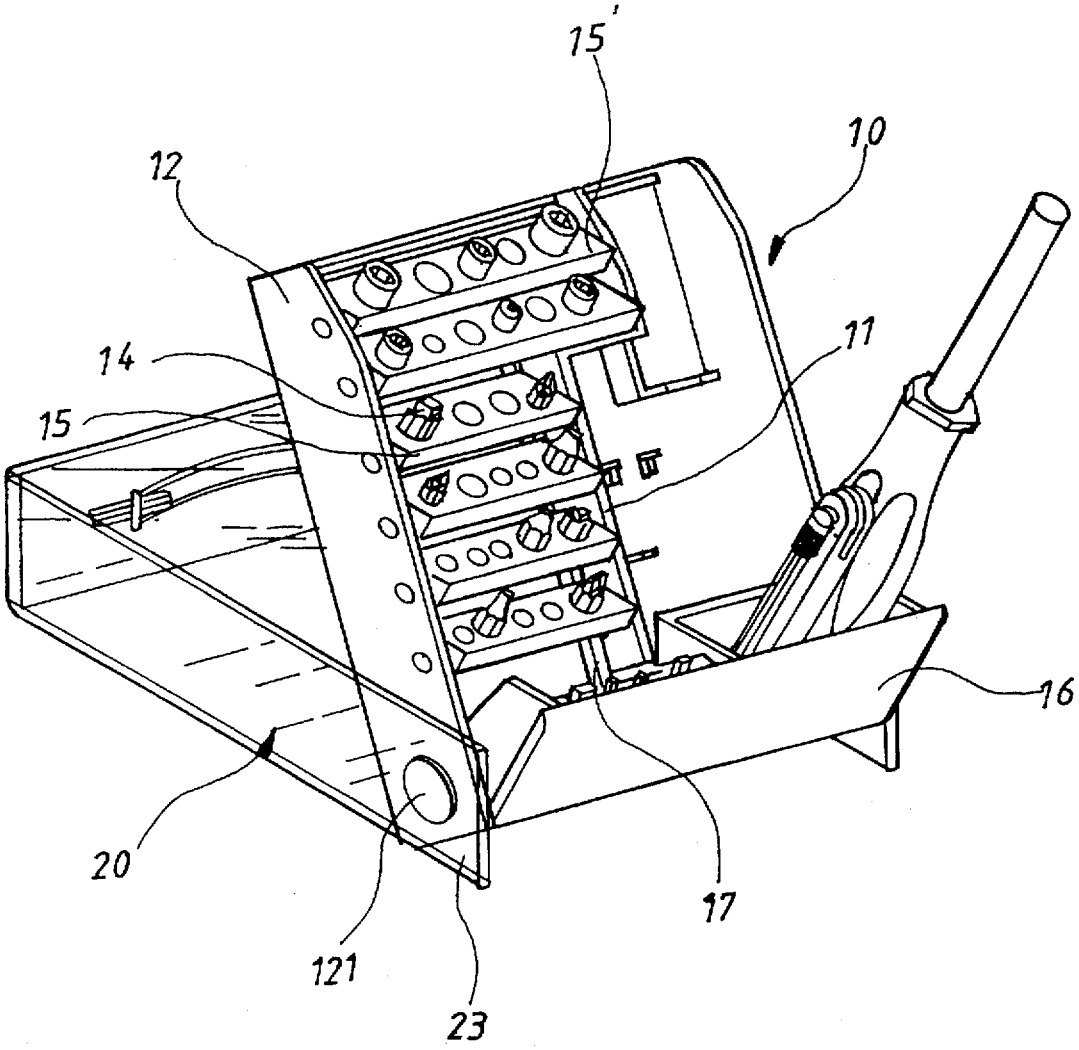
FIG. 4 is a perspective view of the tool box as shown in FIG. 3 wherein an actuating member is pivoted to make receiving members in the base portion to be inclined.

When in use, referring to FIGS. 3 and 4, the cover 20 is pivoted downwardly about the two bosses 121 and turned to a rear side of the base portion 10 so that the cover 20 is able to be put on a desk or the like and the back wall 102 of the base portion 10 is inclinedly leaned on a lower edge of the front plate 200. The actuating member 16 is then pivoted about the two first shafts 161 on the front side thereof, the two sliding plates 17 engaged with the two second shafts 162 are then moved upwardly and the two ends of the rear side of each the receiving member 15 are moved upwardly. Therefore, the receiving members 15 are inclined corresponding to a horizontal plane or the desk and the tools in the recesses 153 of the receiving members 15 and the receiving portions in the actuating member 16 are easily to be accessed.

While particular embodiments of the present invention have been illustrated and described herein, it is not intended to limit the invention and changes and modifications may be made therein within the scope of the invention as hereinafter claimed.

What is claimed is:

1. A tool box comprising:

a base portion having two side walls between which a bottom and a top are respectively transversely connected, a back wall connected between two rear sides of said two side walls;

two sliding plates respectively and slidably disposed to said side walls corresponding thereto, and at least one receiving member pivotally connected between said two side walls at two ends of a front side thereof and pivotally connected between said sliding plates at said two ends of a rear side thereof.

2. The tool box as claimed in claim 1 further comprising an actuating member pivotally connected between said two side walls at two ends of a front side thereof and pivotally connected between said sliding plates at said two ends of a rear side thereof so that when pivoting said actuating member about said two ends of said front side thereof, said two sliding plates are moved upwardly and said two ends of said rear side of said receiving member are moved upwardly.

3. The tool box as claimed in claim 1 further comprising a cover which has a front plate with two side plates extending from two opposite sides thereof, a top plate connected between said two side plates and two legs extending from each of said two side plates, said two legs pivotally connected to said two side walls.

4. The tool box as claimed in claim 3 wherein said two side walls of said base portion each have a boss extending from an outer surface thereof and each of said legs of said cover has a hole defined therethrough so as to receive said boss corresponding thereto.

5. The tool box as claimed in claim 3 wherein said back wall of said base portion inclinedly leans on a lower edge of said front plate when said cover is pivoted downwardly about said two bosses and turned to a rear side of said base portion.

6. The tool box as claimed in claim 1 or 2 wherein said two side walls each have at least two first apertures defined therethrough and said two sliding plates each have at least two second apertures defined therethrough, said two ends of said front side of said receiving member each having a first stub extending therefrom so as to be received in said first apertures of said two side walls, said two ends of said rear side of said receiving member each having a second stub extending therefrom so as to be received in said second apertures of said two sliding plates.

7. The tool box as claimed in claim 6 wherein said two ends of said front side of said actuating member each having a first shaft extending therefrom so as to be received in said first apertures of said two side walls, said two ends of said rear side of said actuating member each having a second shaft extending therefrom so as to be received in said second apertures of said two sliding plates.

8. The tool box as claimed in claim 1 wherein said receiving member has a plurality of receiving recesses defined therein.

* * * * *